United States Patent [19]

Bartell et al.

[11] 4,069,959

[45] Jan. 24, 1978

[54] WEB GUIDE APPARATUS

[75] Inventors: Ronald A. Bartell, Sudbury; George F. Corcoran, Wellesley; Donald H. Fuller, Foxboro, all of Mass.

[73] Assignee: Butler Automatic, Inc., Canton, Mass.

[21] Appl. No.: 736,215

[22] Filed: Oct. 27, 1976

[51] Int. Cl.[2] ..... B65H 25/26

[52] U.S. Cl. ..... 226/21

[58] Field of Search ..... 226/3, 21, 22, 23

[56] References Cited

U.S. PATENT DOCUMENTS

| | | | |
|---|---|---|---|
| 2,797,091 | 6/1957 | Fife | 226/22 |
| 3,390,823 | 7/1968 | Ott | 226/22 |
| 3,581,963 | 6/1971 | Rule | 226/21 X |
| 3,724,732 | 4/1973 | Bonner | 226/21 |

*Primary Examiner*—Richard A. Schacher

*Attorney, Agent, or Firm*—Cesari and McKenna

[57] ABSTRACT

A web steering frame having parallel entering and exiting rollers is supported for pivotal movement on a stationary support frame in a web guide apparatus by a system of pivoted, linear bearings. Each bearing includes a bushing which is movable along a linear guide rod. The bushings are fixed near the rollers where any loads are transmitted to the support frame thereby minimizing steering frame racking. The guide rods are pivotally connected to the support frame. The bearings are oriented so that the direction of linear freedom of each is orthogonal to a line passing through the bearing pivot and the desired steering frame pivot. The linear bearings effectively constrain the steering frame to pivotal motion about the steering frame pivot. Their use gives rise to significant reductions in cost and complexity over conventional web guide apparatus using precision arcuate guides, links or flexures.

4 Claims, 3 Drawing Figures

WEB GUIDE APPARATUS

BACKGROUND OF THE INVENTION

This invention relates generally to web guide apparatus and, more particularly, to an improved support and positioning system for such apparatus.

In numerous industrial and commercial processes, it is necessary that certain operations be performed upon a continuous travelling web of a thin material such as paper, plastic film or the like. In most such processes, it is necessary that the travelling web be maintained in proper registry with a machine that operates on the web. On occasion, however, the web becomes laterally misaligned relative to the machine. It is desirable that any such misalignment of the web be corrected as promptly as possible to avoid web wastage. A web guide apparatus which senses the lateral position of the web and automatically adjusts the web when it deviates from a desired position is commonly used for this purpose.

A typical web guide apparatus includes a stationary support frame which is attached to a floor or machine structure. A movable steering frame is mounted on the support frame. The steering frame includes a pair of spaced, parallel steering rollers over which the web is run. A sensor senses the lateral position of the web as it leaves the steering rollers and generates a signal to control a steering frame positioning device such as a motor or hydraulic cylinder. The motor pivots the steering frame relative to the support frame about a virtual pivot point along the center line axis of the incoming web to steer the web and reposition it laterally.

Various different systems have been utilized in web guide apparatus to support the steering frame for pivotal movement relative to the stationary support frame. Ideally, the support system should prevent rectilinear movement of the steering frame relative to the support frame and allow angular movement thereof only about a pivot axis perpendicular to the plane of travel of the web. Many prior support systems are simply ineffective in providing such single-degree-of-freedom motion, particularly with relatively large width webs which are under considerable tension.

For example, precision arcuate bearings of the type described in U.S. Pat. No. 3,390,823 are often used to support the steering frame. These bearings include arcuate guide bars which are mounted on the stationary support frame and constructed and arranged so as to have a common arc center at a point on the desired pivot axis. Curvilinear followers are slidably received on each of the arcuate guide bars and fixed to the steering frame for movement about the arc center. Unfortunately, in order to provide the desired single degree of freedom motion, such parts must be precision-machined and accurately oriented and mounted to the support structure and steering frame. They thus add considerably to the cost and complexity of the web guide apparatus. Multiple flexure frame supports of the type shown in U.S. Pat. No. 3,615,048 are equally complex and expensive, as are the link support structures found in U.S. Pat. No. 3,373,288.

SUMMARY OF THE INVENTION

Accordingly, it is an object of this invention to provide an improved web guide apparatus.

Another object of the invention is to provide a web guide apparatus including an improved steering frame supporting and positioning system.

Another object of the invention is to provide a steering frame supporting and positioning system for a web guide which is capable of providing single degree of freedom pivotal motion for accurately adjusting the lateral position of a travelling web.

Still another object of the invention is to provide a web guide apparatus of the type described which is relatively simple and inexpensive to make and maintain.

Other objects will in part be obvious and will in part appear hereinafter. The invention accordingly comprises the features of construction, combination of elements and arrangement of parts which are exemplified in the constructions hereinafter set forth and the scope of the invention will be indicated in the appended claims.

Briefly, a web guide apparatus according to the present invention includes a steering frame over which a travelling web to be guided is passed and which is pivotally mounted on a stationary support frame. The steering frame is pivotal about a virtual pivot along the centerline axis of the web entering the steering frame for steering the web and adjusting the lateral position thereof. In accordance with the invention, the steering frame is supported relative to the support frame by a plurality of pivoted linear bearings. Each bearing includes a bushing which is slidable along a linear guide rod. The bushing in each bearing may be fixed to the steering frame and the guide rod may be mounted in a fixture which is pivotally connected to the stationary support frame.

Preferably, a linear bearing of this type is located at each corner of the steering frame below the ends of the rollers and oriented so that its direction of linear freedom is orthogonal to a line passing through the bearing pivot and the desired steering frame pivot. The linear bearings effectively constrain the steering frame for pivotal motion solely about the desired steering frame pivot. Additionally, the bearings being located directly below the roller journals in the frame, transmit loads due to web tension directly to the stationary support frame. This arrangement minimizes racking and other structural deformations of the steering frame as a result of such tension.

Linear bearings of the type found useful herein are more economical and simple to make than the arcuate guides, links and flexures of the type referred to above and commonly utilized in prior web guide apparatus. In fact, such linear bearings are readily available as conventional items from various suppliers. Their use thus gives rise to significant reductions in the cost and complexity of the web guide apparatus without sacrificing web positioning accuracy.

BRIEF DESCRIPTION OF THE DRAWINGS

The foregoing and other features and advantages of the invention will be better understood from the following detailed description taken in conjunction with the accompanying drawings in which.

DETAILED DESCRIPTION OF ILLUSTRATIVE EMBODIMENTS

Figure 1:
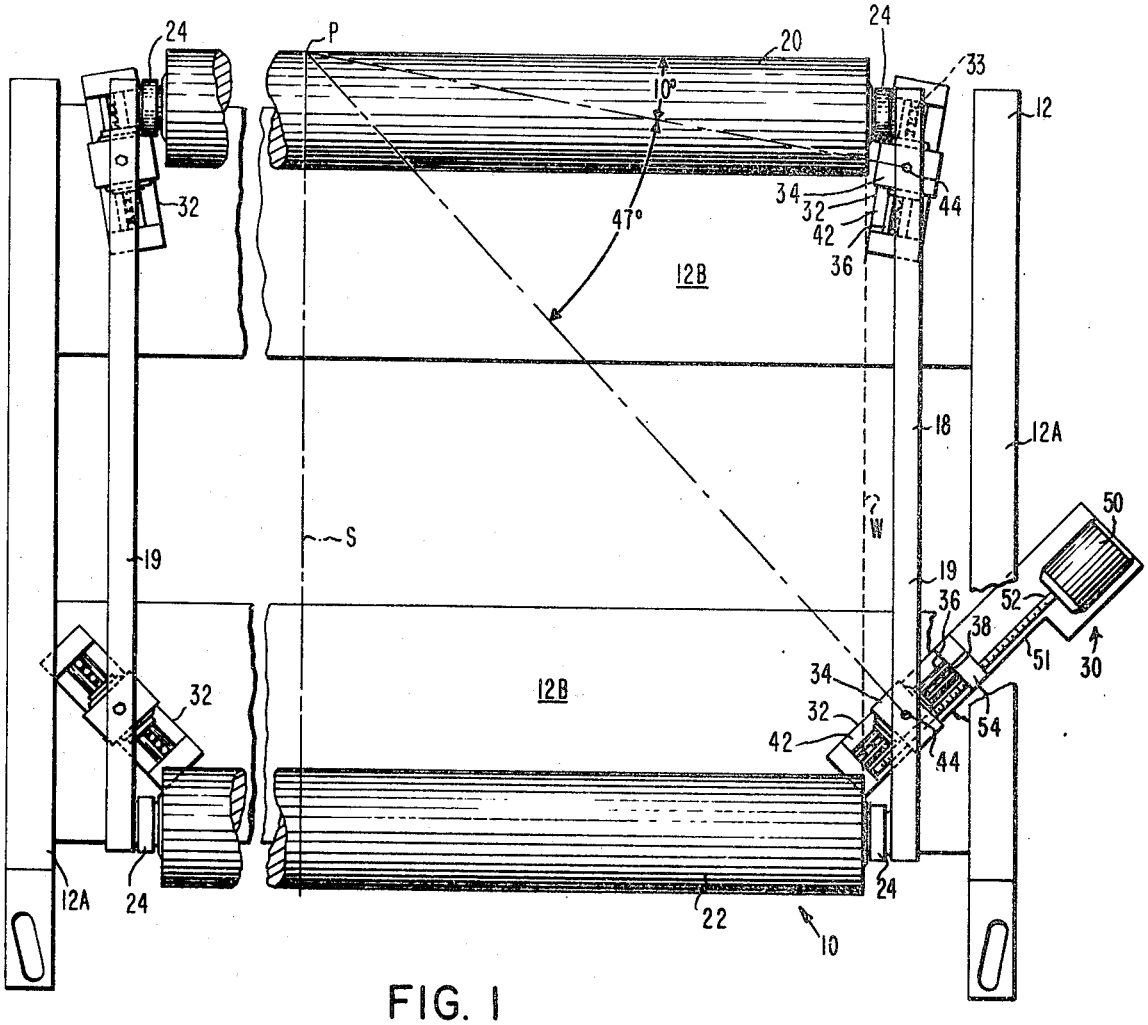
FIG. 1 is a top view, with parts cut away, illustrating a web guide apparatus embodying the invention.
Figure 3:
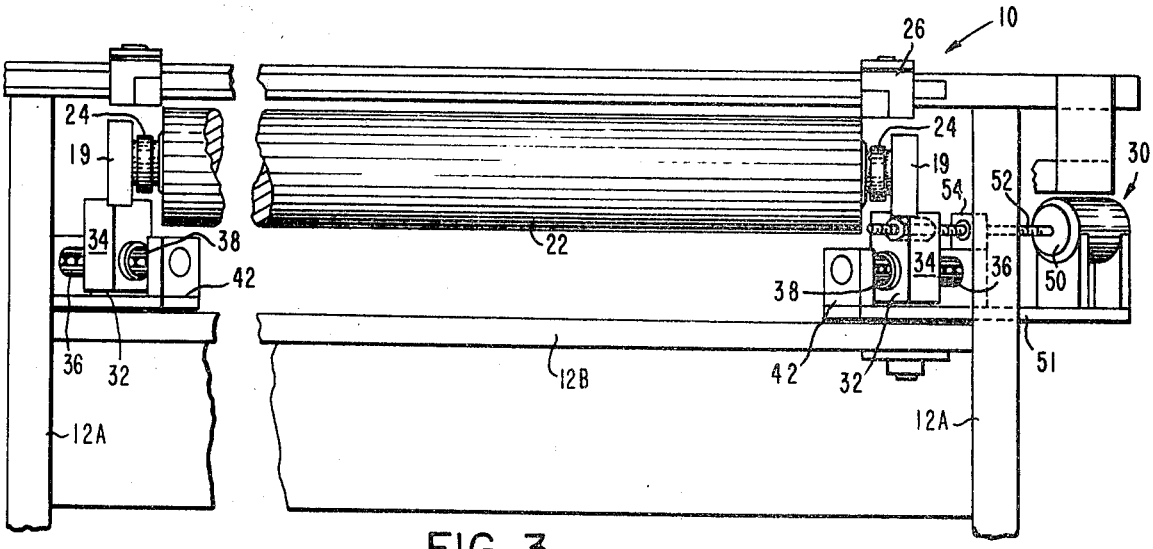
FIG. 3 is a front view, again with parts cut away, of the apparatus of FIG. 1.
Figure 2:
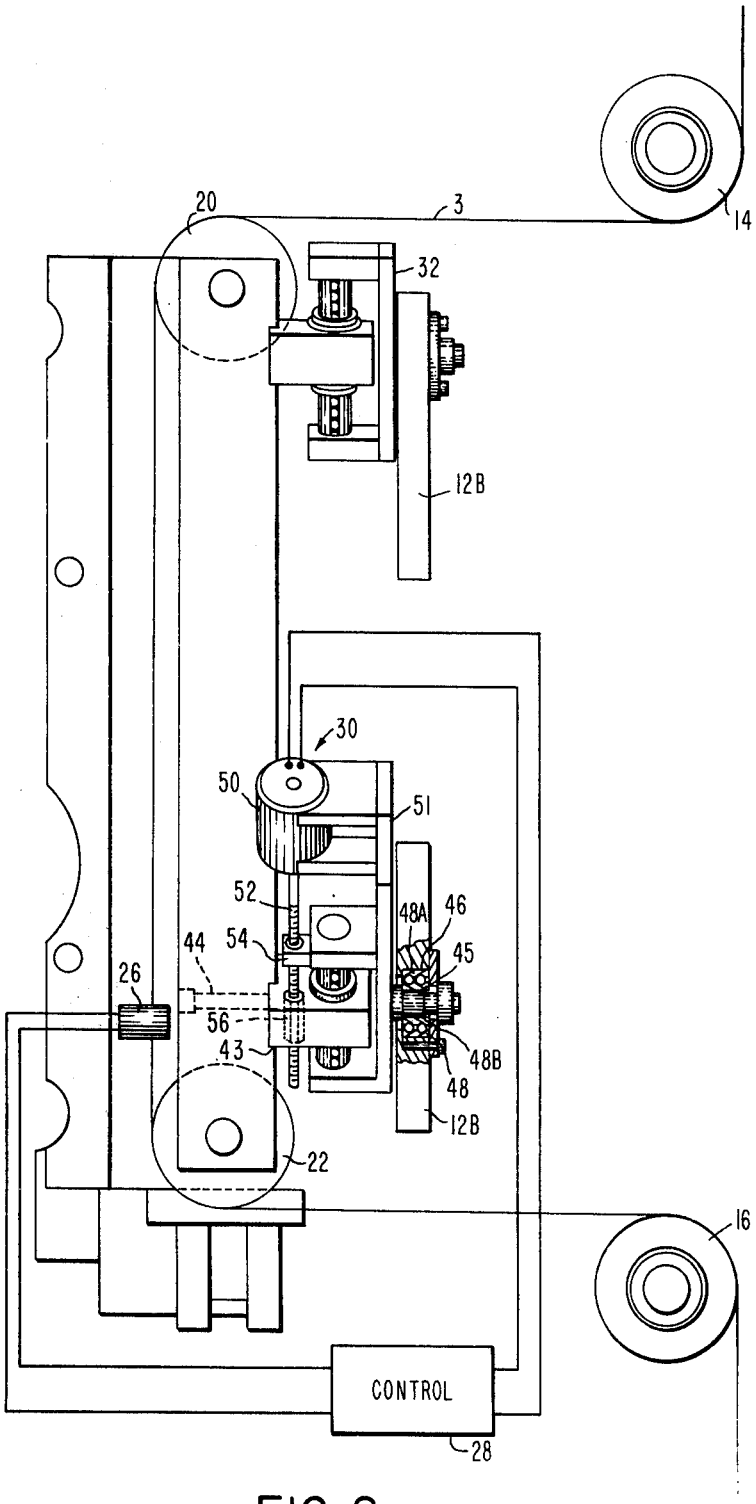
FIG. 2 is a side view, with parts cut away, of the apparatus of FIG. 1.

Referring to FIGS. 1 through 3, there is shown a web guide apparatus indicated generally at 10 and including an improved steering frame supporting and positioning system embodying the invention. The apparatus 10 is adapted for use in web-handling systems for laterally guiding a traveling web W. The apparatus 10 is of the type commonly referred to as a "box" guide, since, as viewed from the side in FIG. 2, the web W passes around four rollers to form a web path in the shape of an inverted box. The web guide apparatus 10 is typically located upstream of a web-consuming machine, such as a printing press (not shown).

More specifically, the apparatus 10 includes a stationary support frame 12 including side frame members 12A and lateral frame members 12B. The side frame members 12A are typically attached to a floor or to a suitably secure machine structure.

A movable steering frame 18 is supported on the support frame 12. The steering frame 18 includes a pair of spaced, parallel side frame members 19. A pair of spaced parallel entrance and exit steering rollers 20 and 22 are supported laterally for rotation in bearings 24 at opposite ends of members 19, completing the frame.

Apparatus 10 also includes a fixed pair of idler rollers 14 and 16 (FIG. 2) supported for rotation between the side frame members 12A. Rollers 14 and 16 are parallel to rollers 20 and 22 and positioned so that the stretches of web W between rollers 14 and 20 and between rollers 16 and 22 are perpendicular to the web stretch between rollers 20 and 22.

The frame 18 including rollers 20 and 22 is supported on the support frame 12 for pivotal movement about a virtual pivot point P (FIG. 1) on the centerline axis of the web W approaching roller 20. The frame 18 is movable in either direction about pivot point P from a reference position in which rollers 20 and 22 are perpendicular to the centerline axis of the web W downstream from apparatus 10. Thus, if the web W wanders in one direction from the desired path of travel, for example, to the right in FIG. 1, the steering frame 18 may be pivoted through a small (eg. 1° to 3°) angle in the opposite direction, for example, to the left in FIG. 1, to correct the deviation of the web W from the desired path of travel.

The apparatus 10 further includes a web edge sensor 26 (FIG. 2) located to sense lateral deviations of the web W from its reference position and to generate a web position error signal in response to such deviations. A control unit 28 (FIG. 2) receives the error signal from the sensor 26 and controls a steering frame positioning device 30 to automatically displace the frame 18 angularly about the pivot point P as needed to return the web W to its reference position. The sensor 26 and control unit 28 may be conventional components adapted for edge guiding of the web W, as illustrated in the figures, or for centerline guiding of the web, as desired. The positioning device 30 is described in further detail herein below.

Since lateral displacement of web W is achieved by pivoting frame 18 about point P, the edges of web W leaving exiting roller 22 are shifted not only laterally, but also longitudinally making it difficult to place a high resolution web position sensor at the exiting web position. Conventionally, this problem is taken care of by means of a pass line follower in which the sensor mounted just downstream for the exiting roller 22 is moved longitudinally by the movement of frame 18 in such a way that the sensor maintains a fixed longitudinal relationship to the web edge. Such arrangements are described in the above patents and can be used in the present apparatus.

Preferably, however, the sensor 26 is located somewhat upstream from the exiting roller 22. This would normally give rise to a small geometrical error in web positioning. However, by using a laser web edge guide of the type disclosed in co-pending application Ser. No. 638,433 filed 12/8/75 entitled LASER WEB EDGE GUIDE, the error is eliminated. This is because the rays illuminating the web edge are all parallel so that the performance of the guide is unaffected by the longitudinal motion of the web edge.

In accordance with the invention, the steering frame 18 is supported on the support frame 12 using a system of pivoted, linear motion bearings 32. Each bearing 32 may comprise a conventional linear ball bushing 34 which is movable along a linear ball bushing guide rod 36. Illustratively, each guide rod 36 includes a plurality of tracks 38 in which ball bearings are free to move to facilitate movement of the bushing 34 back and forth along the rod 36.

As best seen in FIG. 1, the bearings 32 are positioned near the respective corners of the steering frame 18 below roller bearings 24. Each bearing 32 is mounted by seating its bushing 34 in a slot 43 (FIG. 2) formed in the undersurface of a frame member 19 and retaining it there by a bolt 44 extending through member 19. Each slot 43 and bushing 34 is oriented so that the direction of linear freedom thereof is orthogonal to a line passing through the center of the bolt 44 and the pivot point P. The pivot point P thus locates the unique intersection of four imaginary lines, each of which is orthogonal to the single degree of linear freedom of a bearing 32.

Each guide rod 36 is fixedly mounted in a generally U-shaped fixture 42 which is, in turn, supported by the lateral frame member 12B of the support frame 12. In order that each bushing 34 may move in an arc about the pivot point P, the guide rod fixtures 42 are pivotally mounted to the frame members 12B. As best seen in FIG. 2, each fixture 42 includes a shaft 45 projecting from the undersurface thereof which is received in a corresponding opening 46 through the frame member 12B. Pivotal freedom for the shaft 45 may be provided by a bearing 48 such as a conventional double row ball bearing whose outer race 48A is secured within the opening 46 and whose inner race 48B is secured to the shaft 45. Any conventional linear ball bearing can be used in apparatus 10. A suitable one is sold by Thomson Industries, Inc., Manhasset, N.Y.

The above arrangement of pivoted linear bearings 32 satisfies all first order requirements for angular freedom of the steering frame 18 to rotate relative to the stationary support frame 12 about the pivot point P. The arrangement also effectively constrains relative motion of the steering frame 18 in the other five degrees of freedom. Additionally, by selecting the span distance S between the steering rollers 20 and 22 to be between 50 and 100% of the web width, the angles of rotation of the steering frame 18 required to accomplish ±2% to ±5% lateral web displacements are in the range of only up to ±3°. (For example, with a 40 inch wide web, a span distance S of 20 inches and a lateral web displacement of ±1 inch, the angle of rotation of the steering frame 18 is given by arctan ±1/20 or ±2.862°). With such small angular rotations of the steering frame 18, second order requirements for angular freedom need not be satisfied since they are negligibly small compared to the radial and angular tolerances normally encountered with conventional bearings.

In most web handling systems, the traveling web W is under considerable tension and thus induces significant loads on the steering frame 18. By mounting the bearings 32 near each corner of the steering frame 18 in the manner described above, these loads are evenly and directly distributed to the stationary support frame 12. Structural deformations of the steering frame 18 as a result of web tensions are therefore minimized. Such deformations would obviously have undesirable effects on web steering and running if allowed to become significant.

It will be apparent from the above description that if linear motion is imparted to or restrained in any one of the bearings 32, then angular motion about the pivot point P will also be imparted to or restrained in the steering frame 18. Advantage can be taken of this fact in controlling the position of the steering frame 18.

Specifically, as indicated in FIGS. 1 and 2, the positioning device 30 referred to above may be in the form of a motor 50 which is mounted upon an extension 51 of the fixture 42 supporting the guide rod 36 of one of the bearings 32. The output shaft of the motor 50 is coupled to a rotatable lead screw 52 mounted in bearings 54 on the fixture 42 so that its axis is parallel to the centerline of the guide rod 36. A cage nut 56 is secured within the bushing 34 so that it is constrained from rotating when the lead screw 52 is driven rotationally by the motor 50. Thus, by operating the motor 50 in a servo-positioning mode of control, motor angular position is converted to linear displacement of the bushing 34 along the guide rod 36 in the bearing 32 and thus to pivotal motion of the steering frame 18 about the pivot point P. Since the motor 50 pivots with the guide rod fixture 42, the lead screw 52 and cage nut 56 maintain proper alignment regardless of the angular position of the steering frame 18.

Obviously, a positioning motor of the type described above may similarly be mounted on one or more of the other bearings 32 in the apparatus 10. Additionally, the guide rod 36 and bushing 34 in one or more of the bearings 32 may be provided with mating threads so that the guide rod 36 itself serves as the lead screw 52. In such a case, the guide rod 36 should be free to rotate within its corresponding fixture 42 so that the motor output shaft may be coupled to rotate the guide rod 36 relative to its fixture 42. Furthermore, instead of using the positioning motor 50 to control the relative position of the bushing 34 on the guide rod 36, that position could be controlled by other means, e.g., hydraulically. One or more of the linear bearings 32 could thus be in the form of hydraulic cylinders. Alternatively, the frame 18 can be shifted by a standard linear actuator acting between support 12 and a frame member 19 as shown for example in U.S. Pat. No. 3,581,963.

Thus, the foregoing steering frame support system comprising pivoted, linear bearings 32 supports the steering frame 18 so as to constrain it to rotate about the pivot point P at the center of the steering roller 20. The linear bearings 32 of the system may be conventional components which are relatively inexpensive and readily available. For this reason, the overall apparatus 10 is relatively easy and inexpensive to make. Furthermore, the linear bearings 32 are generally quite rugged and reliable and require a minimum amount of maintenance.

It is to be understood that the above description and accompanying drawing are illustrative only of specific embodiments of the invention and that numerous modifications can be made thereto by those skilled in the art without departing from the scope of the invention. For example, although a preferred mounting arrangement for the bearings 32 was shown and described in which the bushings 34 are fixed to the steering frame 18 and the guide rods 36 are pivotally mounted to the support frame 12, other mounting arrangements are possible. For example, the bearings 32 can also be mounted in an inverted position in which the bushing 34 in each bearing 32 is fixed to the support frame 12 and the guide rod 36 is pivotally mounted to the undersurface of the steering frame 18. It is also possible to pivotally mount the bushing 34 in each bearing 32 to the steering frame 18 and to fixedly mount the guide rod 36 to the support frame 12 provided the respective orientations of the guide rods 36 are properly selected.

It is thus understood that the following claims are intended to cover all of the generic and specific features of the invention herein described.

We claim:

1. Web guide apparatus for laterally guiding a travelling web comprising:

A. a stationary support frame;

B. a steering frame for receiving the travelling web including first and second spaced parallel side members and entering and exiting spaced steering rollers mounted between said side members near the ends thereof and rotatable about spaced, parallel axes extending transversely of the web;

C. means for supporting said steering frame on said support frame for relative pivotal movement about a pivot axis corresponding to the centerline axis of the web approaching the entering roller, said supporting means comprising i. four linear bearings each including a bushing and a linear guide rod along which said bushing is movable in a linear path;

ii. means fixedly mounting the bushings in said bearings to the side members near the ends of said steering rollers and, iii. means pivotally mounting the guide rods in said bearings to the support frame so that the linear path of each bearing is in a plane parallel to the plane defined by the rotational axes of said rollers, and D. means for controlling the angular position of said steering frame about its pivot axis, thereby adjusting the lateral position of the web leaving said steering frame.

2. Web guide apparatus as recited in claim 1 further including means for sensing a deviation in the lateral position of the web relative to a predetermined reference position and for generating a signal indicative therof, said controlling means being responsive to the signal from said sensing means for adjusting the angular position of said steering frame about its pivot axis in a direction to reduce the deviation.

3. Web guide apparatus as recited in claim 2 in which said controlling means includes means responsive to the signal from said sensing means and operatively coupled to at least one of said bearings for adjusting the relative position of said first and second bearing means of said one bearing along its linear path thereby adjusting the angular position of said steering frame about its pivot axis.

4. Web guide apparatus as recited in claim 1 further including means for sensing a deviation in the lateral position of the web relative to a predetermined reference position and for generating a signal indicative thereof, in which said controlling means includes motive means mounted upon an extension of said guide rod fixture in at least one of said bearings, said motive means being responsive to the signal from said sensing means for adjusting the relative position of said bushing on said guide rod of said one bearing thereby adjusting the angular position of said steering frame about its pivot axis in a direction to reduce the deviation.

* * * * *